United States Patent [19]

Mielsch

[11] Patent Number: 4,929,327

[45] Date of Patent: May 29, 1990

[54] ARRANGEMENT FOR PRODUCING DISPERSION LAYERS

[75] Inventor: Goetz Mielsch, Munich, Fed. Rep. of Germany

[73] Assignee: Bayerische Motoren Werke AG, Fed. Rep. of Germany

[21] Appl. No.: 280,941

[22] Filed: Dec. 7, 1988

[30] Foreign Application Priority Data

Dec. 16, 1987 [DE] Fed. Rep. of Germany ..... 3742602

[51] Int. Cl.[5] ..... C25D 17/00

[52] U.S. Cl. ..... 204/272; 204/273; 204/286

[58] Field of Search ..... 204/272, 273, 275, 279, 204/286, 297 R

[56] References Cited

U.S. PATENT DOCUMENTS

| | | | |
|---|---|---|---|
| 2,406,956 | 9/1946 | Matthews | 204/272 |
| 3,061,537 | 10/1962 | Yagishita | 204/275 |
| 3,464,910 | 9/1969 | Krebs et al. | 204/275 X |
| 3,582,525 | 6/1971 | Hahn et al. | 204/275 X |
| 3,718,540 | 2/1973 | Bailey | 204/275 X |
| 3,957,596 | 5/1976 | Seto | 204/275 X |
| 4,065,375 | 12/1977 | Newton | 204/275 X |
| 4,645,580 | 2/1987 | Paulet et al. | 204/272 |

FOREIGN PATENT DOCUMENTS

| | | |
|---|---|---|
| 0190539 | 8/1986 | European Pat. Off. . |
| 2261776 | 7/1974 | Fed. Rep. of Germany . |

*Primary Examiner*—Donald R. Valentine

*Attorney, Agent, or Firm*—Evenson, Wands, Edwards, Lenahan and McKeown

[57] ABSTRACT

In order to produce differently thick dispersion layers on inner surfaces of hollow bodies, it is proposed according to the present invention to permit electrolyte to flow into the hollow body by way of a swirl-producing flow body, whereby the flow is split up into a laminar and a turbulent component. With turbulent flow, a high build-up rate of the solid particles is achieved than with laminar flow so that layes of different concentration can be realized in a single operation.

12 Claims, 2 Drawing Sheets

ARRANGEMENT FOR PRODUCING DISPERSION LAYERS

BACKGROUND AND SUMMARY OF THE INVENTION

The present invention relates to an arrangement for producing dispersion layers on the inner surfaces of hollow cylinders open at least on one side thereof, especially on contact or slide surfaces in cylinders for internal combustion engines, whereby an electrolyte together with the solid particles to be deposited are conducted over the surface to be coated at the outer circumference of an anode centrally arranged in the cylinder axis and the electrolyte is introduced into the cylinder with the aid of a swirl-producing flow body.

The DE-OS 22 61 776 describes a known arrangement. In this prior art arrangement, a very high swirl or vortex flow is produced for increasing the build-up rate of the solid particles at the surfaces to be coated. The build-up rate can be considerably increased therewith. However, only a build-up rate uniform over the entire length of the surface to be coated is achieved therewith.

Investigations in cylinder slide or contact surfaces of reciprocating piston internal combustion engines have indicated that within the area of the upper reversing point of the piston, an increased wear occurs at the cylinder contact or slide surfaces.

In order to reduce this wear, one could provide by means of the known process an increased build-up rate of the wear-preventing solid particles over the entire cylinder contact or slide surfaces. This, however, makes sense only for small series. In case of large series and/or multi-cylinder large-volume internal combustion engines, this represents a very uneconomical procedure because correspondingly many wear-reducing solid particles would have to be deposited at surfaces, and more particularly in such a thickness as is not necessary.

It is the object of the present invention to further develop an arrangement of the aforementioned type to the effect that deliberately controlled differently dense build-up rates of the wear-reducing solid particles is made possible in a single operating step.

The underlying problems are solved according to the present invention in that the swirl-producing flow body conducts the electrolyte in such a manner that the flow splits off into a laminar and turbulent flow component. The present invention is based on the recognition that with the aid of a turbulent flow an increased build-up rate of the wear-reducing solid particles can be achieved. Care should therefore be taken at the requisite places that a turbulent flow of the electrolyte is maintained thereat. As soon as this turbulent flow converts itself into a laminar flow, the build-up rate of the solid particles is reduced. One achieves then a considerably thinned-out dispersion layer which, however, corresponds to the reduced wear requirements. An economic procedure is achieved thereby because the more wear-resistant concentric layers are produced only where they are absolutely necessary.

According to another feature of the present invention, the flow body includes within the plane of the inflow a spirally shaped annular channel for the electrolyte which is in communication with a swirl or vortex chamber by way of an overflow channel arranged obliquely to the hollow cylinder longitudinal axis. This arrangement of the flow body permits the realization of a turbulent flow at the inlet and subsequently a laminar flow at the surfaces to be coated.

An accurately defined and reproducible boundary between the different concentrations of the wear-resistant layers can be achieved if the swirl chamber is constructed as circumferential annular channel with circularly shaped cross section and having a circumferential deflection nose, as viewed in the flow direction. This boundary is marked by a change from the turbulent to the laminar flow.

According to still other features of the present invention, the flow body is arranged outside of the hollow cylinder and is sealingly connected with the same and is constructed at the same time as anode support while the swirl chamber is constructed two-partite wherebY the lower part connected with the overflow channels is formed by the flow body itself and the upper part by the anode. A flow body constructed in such manner is particularly suited for use with cylinder contact or slide surfaces of reciprocating piston internal combustion engines. It is assured thereby that only the cylinder contact or slide surfaces which are to be coated will, in fact, also be coated. All of the remaining parts of the crankcase forming the cylinder contact or slide surfaces are not unnecessarily coated.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
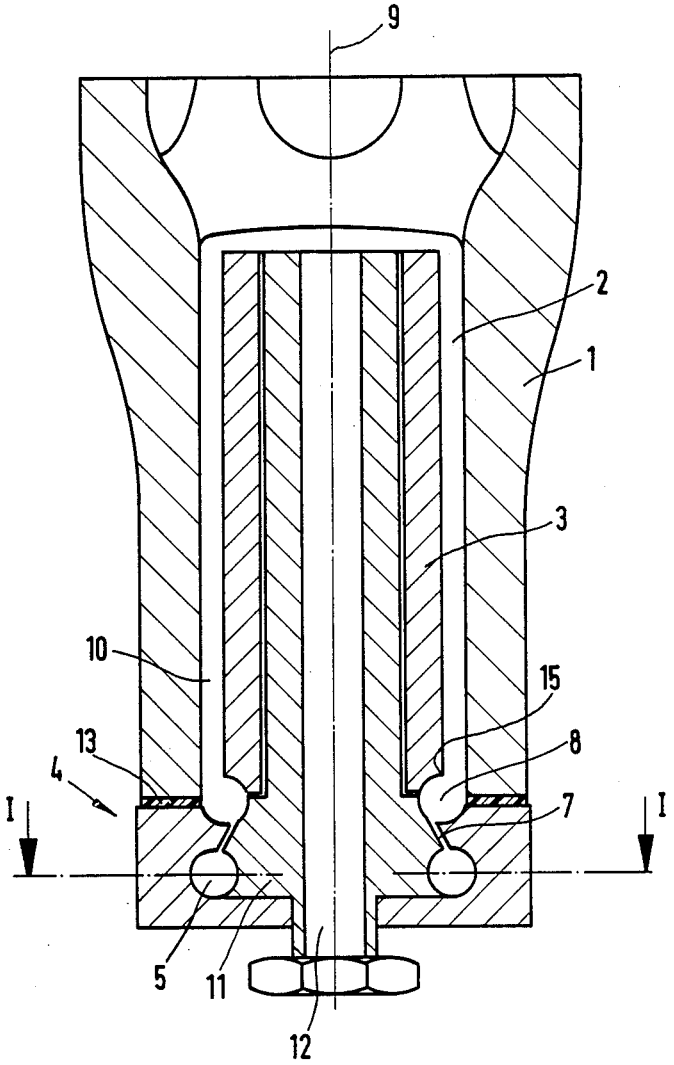
FIG. 1 is a cross-sectional view through a coating arrangement constructed according to the present invention with parts of a crankcase of a reciprocating piston internal combustion engine.

Referring now to the drawing wherein like reference numerals are used throughout the various views to designate like parts, and more particularly to FIG. 1, a crankcase 1 of an internal combustion engine is schematically illustrated in cross section in this figure. The cylinder bore is designated in this figure by reference numeral 2 in which a piston carries out an oscillating movement when the internal combustion engine is completely assembled.

An anode 3 is disposed in the cylinder bore 2 which is retained by a flow body generally designated by reference numeral 4.

Figure 2:
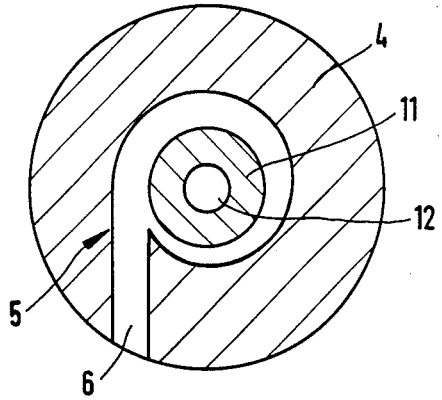
FIG. 2 is a transverse cross-sectional view through the flow body according to FIG. 1.

The flow body 4 includes an annular channel 5 which—as illustrated in FIG. 2—is constructed spirally shaped in such a manner that the liquid conducted through the inlet 6 into the annular channel 5 experiences with increasing through-flow a velocity increase.

Overflow channels 7 extend from the annular channel 5 into a swirl or vortex chamber 8. The overflow channels 7 are directed obliquely to the cylinder axis 9 and are also arranged annularly shaped so that the liquid entering into the annular channel 5 can enter into the overflow channels 7 at every place.

The overflow channels 7 are connected with the swirl chamber 8 which is also arranged circumferentially. In cross section, it has a circularly shaped contour. From there, the liquid reaches the annular gap 10 which is formed between the cylinder bore 2 and the outer circumference of the anode 3.

The anode 3 is seated on an anode support 11 which has a central bore 12 that serves as overflow and discharge for the liquid transported into the annular gap 10.

Additionally, a seal 13 is present between the flow body 4 and the crankcase 1.

The operation of the arrangement according to the present invention will now be explained more fully with the assistance of FIG. 3.

Figure 3:
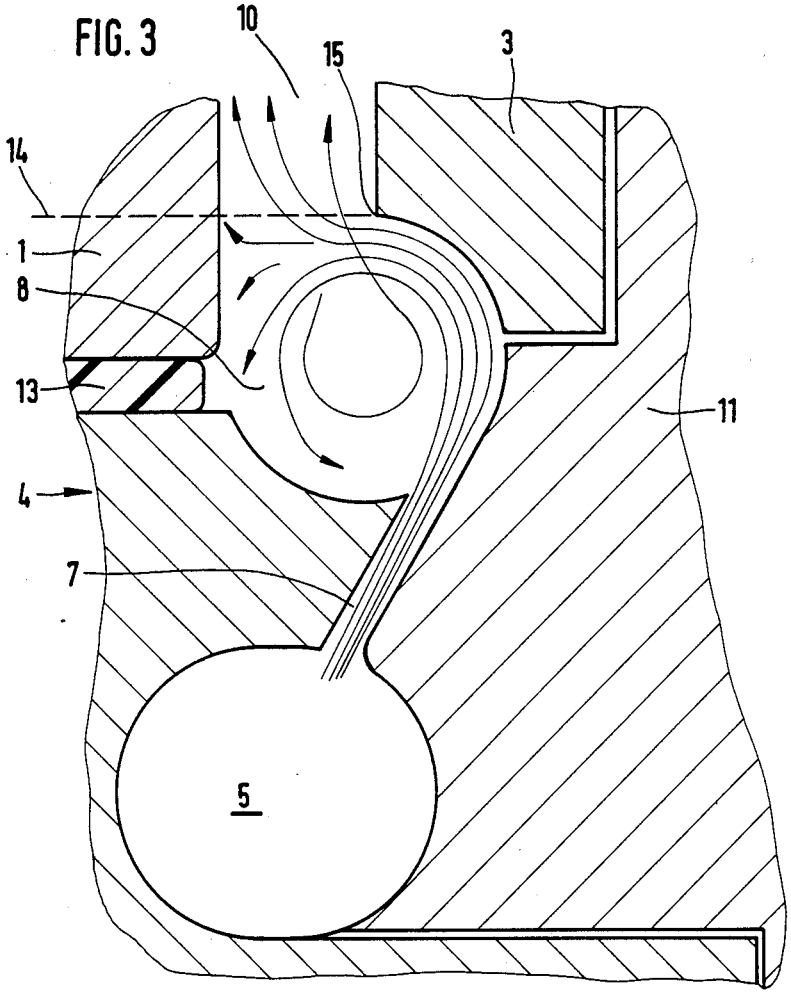
FIG. 3 is a somewhat schematic illustration of the flow progress in the swirl chamber.

As shown in particular in FIG. 3 which illustrates an enlarged cross section of one-half of the flow body 4, the swirl chamber 8 is formed in its lower part by the flow body 4, respectively, by the anode support 11. The upper part of the swirl chamber 8 is formed by a partial circumference of the anode 3 as well as by a part of the wall of the crankcase 1 to be coated. This construction offers the advantage that by reason of the obliquely inwardly directed overflow channels 7, the impact surface for the flow conducted therethrough is formed by the anode 3 so that the latter which is anyhow subject to wear, can be exchanged in regular intervals.

In order to be able now to deposit a thickened layer of wear-reducing solid particles in the upper part of the cylinder bore 2 which in FIG. 3 is designated by reference numeral 14, a turbulent flow is produced according to the present invention within this area. By reason of the spiral channel 5, the flow is decomposed in the overflow channel 7 into two main components, namely, on the one hand, into a vertically upwardly rising portion and, on the other, into a tangential portion. By reason of this subdivision a turbulent flow is now produced in the swirl chamber 8 which guides the solid bodies to be deposited in a reinforced manner against the upper area 14. This area is delimited by the deflection nose 15 which is formed by the circularly shaped segment of the anode 3 and the vertically extending circumferential wall thereof. In the flow direction of the liquid above this deflection nose, the liquid flow is realized laminar. This means a lesser build-up rate. As a result thereof, the surface to be coated which adjoins the area 14 is coated with a solid particle layer of lesser concentration which corresponds to a lesser wear resistance.

By reason of the construction according to the present invention of the annular channel as well as of the overflow channel and the swirl chamber, a different concentration of solid particles can be achieved at the wall of the cylinder bore in a single operation.

The length of the layer with the greater layer thickness, i.e., the height of the area 14 is thereby delimited by the position of the deflection nose 15.

Preferably silicon carbide particles are used as wear-reducing solid particles if aluminum is provided as base material. Suitable electrolytes are known as such.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An arrangement for depositing variable thickness dispersion layers on inner surfaces of hollow cylinders open at least on one side thereof, comprising anode means, swirl-producing flow body means, an electrolyte together with solid particles to be deposited being conducted to contact the inner surface of the hollow cylinder to be coated and along the outer circumference of the anode means arranged substantially centrally in the cylinder axis, the electrolyte being conducted into the cylinder by means of the swirl-producing flow body means, and the swirl-producing flow body means conducting the electrolyte in such a manner that the electrolyte flow is divided into a laminar and a turbulent portion to deposit a thicker layer of electrolyte on the cylinder inner surface where the turbulent portion contacts the cylinder and a thinner layer where the laminar portion contacts the cylinder.

2. An arrangement according to claim 1, wherein the flow body means includes in the plane of its inflow a spirally shaped annular channel means for the electrolyte which is in communication with a swirl chamber means by way of an overflow channel means arranged obliquely to the hollow cylinder longitudinal axis.

3. An arrangement according to claim 2, wherein the swirl chamber means is constructed as circumferential annular channel with a substantially circular cross section and including a deflection nose means circumferential as viewed in the flow direction.

4. An arrangement according to claim 3, wherein the flow body means is arranged outside of the hollow cylinder and is sealingly connected with the same.

5. An arrangement according to claim 4, wherein the flow body means is constructed as an anode support means.

6. An arrangement according to claim 5, wherein the swirl chamber means is constructed two-partite, the lower part connected with the overflow channel means being formed by the flow body means and the upper part by the anode means.

7. An arrangement according to claim 6, wherein the hollow cylinders form slide surfaces in cylinders for reciprocating piston internal combustion engines.

8. An arrangement according to claim 2, wherein the swirl chamber means is constructed two-partite, the lower part connected with the overflow channel means being formed by the flow body means and the upper part by the anode means.

9. An arrangement according to claim 1, wherein the flow body means is arranged outside of the hollow cylinder and is sealingly connected with the same.

10. An arrangement according to claim 9, wherein the flow body means is constructed as an anode support means.

11. An arrangement according to claim 1, wherein the hollow cylinders form slide surfaces in cylinders for reciprocating piston internal combustion engines.

12. An arrangement according to claim 1, wherein the flow body means is constructed as an anode support means.

* * * * *